United States Patent [19]

Bryant

[11] 4,039,217

[45] Aug. 2, 1977

[54] CLUTCH PADS

[76] Inventor: John G. Bryant, 15 Ridgewood Road, Radnor, Pa. 19087

[21] Appl. No.: 204,932

[22] Filed: Dec. 6, 1971

Related U.S. Application Data

[63] Continuation-in-part of Ser. No. 886,706, Dec. 19, 1969, abandoned.

[51] Int. Cl.[2] ..... B66C 1/12

[52] U.S. Cl. ..... 294/74

[58] Field of Search ..... 294/74, 78; 224/49, 224/56, 58; 212/45, 82, 83, 85

[56] References Cited

U.S. PATENT DOCUMENTS

| | | | |
|---|---|---|---|
| 873,044 | 12/1907 | Hanson | 294/74 |
| 2,985,480 | 5/1961 | Otley | 294/74 |
| Re. 26,704 | 11/1969 | Norton | 294/74 |

OTHER PUBLICATIONS

Wear-Flex Corp. Publication (1-1-66), regarding U.S. Patent No. 3,290,083.

*Primary Examiner*—Johnny D. Cherry
*Attorney, Agent, or Firm*—Frederick J. Olsson

[57] ABSTRACT

Pad devices disposed between a lift sling and a load and permitting relative sliding motion between the load and the sling without the load and sling being in direct engagement and thereby avoid and/or minimize damage to the sling and to the load.

19 Claims, 14 Drawing Figures

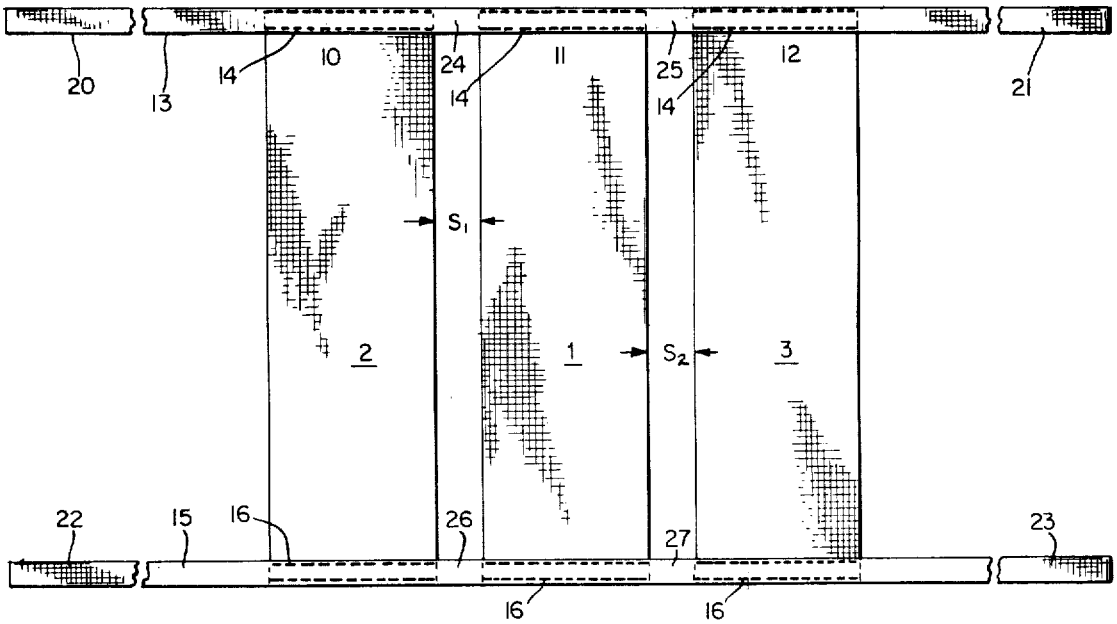
Fig. 1
Fig. 2
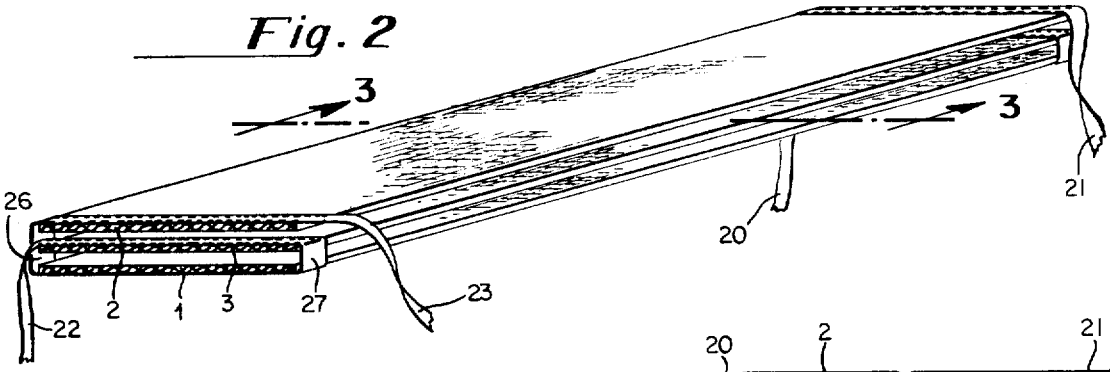
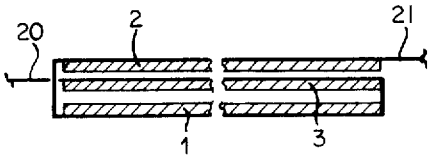
Fig. 3
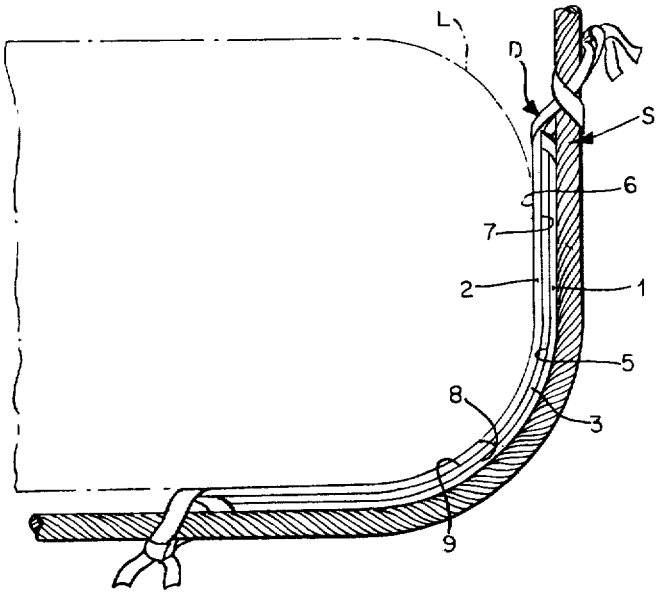
Fig. 4

CLUTCH PADS

This application is a continuation-in-part of my pending application Ser. No. 886,706 filed Dec. 19, 1969, now abandoned and entitled CLUTCH PAD FOR A LIFTING SLING.

This invention relates in general to overhead materials handling equipment and more specifically the invention relates to a novel item which I have termed a sling clutch pad.

The primary object of the invention is to provide a means to be disposed between a sling and the load to be lifted thereby which will accomodate the inevitable shifting or relative motion between sling and load during lift without the load directly engaging and thereby imposing cutting and/or abrasive forces on the sling and thereby minimize damage to the sling and damage to the load.

Another object of the invention is to provide a device of the kind in question which will operate to greatly boost the safety margins in overhead lifting operations.

Another object of the invention is to provide a device of the kind in question which will operate in a manner to greatly prolong the operating life of a sling.

Another object of the invention is to provide a device of the kind in question which will operate in a manner to eliminate or greatly minimize the likelihood of damage to the load.

With the above in mind the invention will be described below in connection with the following drawings wherein:

FIG. 1 is a plan view of a sling pad constructed in accordance with the invention and arranged in folded out condition;

FIG. 2 is a perspective view of a sling pad of FIG. 1 arranged in folded over condition;

FIG. 3 is a fragmentary sectional view taken along the lines 3—3 of FIG. 2;

FIG. 4 is a fragmentary view illustrating a pad of the invention interposed between a sling and a load;

Figure 9:
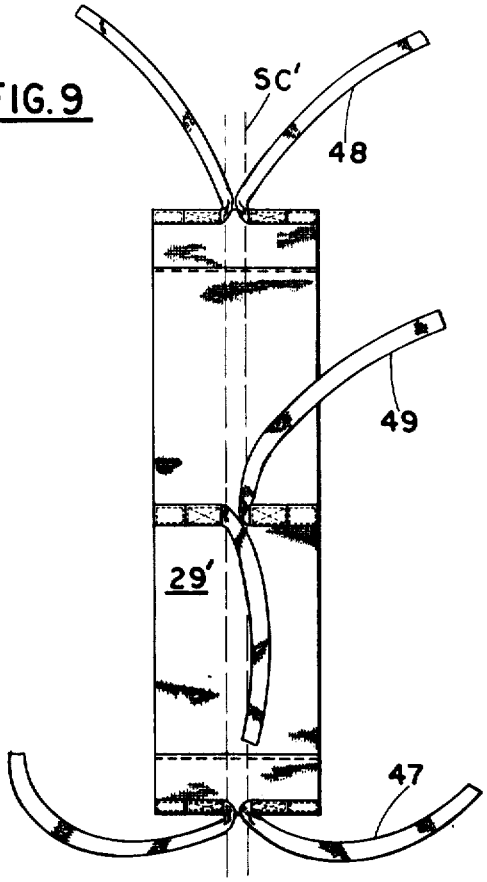
FIG. 9 is a plan view of the pad of FIG. 5 illustrating another method for arrangement of the tie straps.

With reference to FIG. 4 the dot and dash lines L represent a typical load to be lifted and the letter S represents a typical cable-type sling which is arranged to extend underneath the load and then extend upwardly where it is connected to the lift mechanism. Between the load and the sling is the pad P of the invention. In lifting condition (as shown) the pad is in direct contact with both the load and the sling and functions to separate the load and sling so that they are not in direct contact or engagement.

The load representation in FIG. 4 has been shown with rounded corners for descriptive purposes only. As will be understood by those skilled in the art in many types of operations the loads to be lifted have square or sharp corners.

In sling lifting operations, there is some relative sliding motion between the sling and the load. One of the principal reasons is due to the fact that the load causes the sling to stretch and this is particularly true with cable type slings. Stretching also occurs because of shock stress developed, for example, where a load is being transferred by an overhead crane which is stopped abruptly rather than with an even deceleration. Some stretching and indeed actual movement of the load occurs where there is twisting or swinging during transportation.

While the above referred to motion is relatively small for example, only a few thousandths of an inch, the same has a rather devasting effect on the sling. For example, where the load has sharp corners the motion will cause the corner to act as a knife and cut into and in many instances entirely sever the sling. In other instances where sharp corners are not involved, the relative motion results in an abrasive action of the load on the sling which causes wear and eventual severing of the sling structure.

The conditions referred to above are extremely undesireable from the standpoint of safety. Breakage of slings with the consequent dumping of the load is a frequent occurrence. The conditions mentioned, therefore, represnt a constant threat of injury to personnel and damage to property. As a consequence, slings must be frequently replaced and the low rate of work life represents a substantial cost in overhead lifting operations.

The present invention as illustrated in FIG. 4 disposed between the load and the sling permits the inevitable relative motion between load and sling without the sling and load being in direct contact or engagement. Thus, the cutting or wear of the sling is essentially eliminated which greatly boots safety margins and greatly prolongs the operating life of slings.

The device P is, in some resepcts, in the nature of a slip clutch in that it will respond to the relative motion of the load and slip at the time it is necessary for the same to occur. It has, however, an additional and an extremely important function of separating the load and the sling so that the relative motion can occur without the sling and the load being in direct contact.

Another advantage of the pad is that it minimizes or eliminates damage to the load which otherwise would be caused by the sling being in direct contact.

As illustrated in FIG. 4 the pad includes an outer ply 1 and an inner ply 2 and a middle ply 3. The outer ply 1 has an outer surface 4 in direct contact with the sling. The outer ply also has an inner surface 5 and contact with the middle ply 3. The inner ply 2 has an outer surface 6 in contact with the load and an inner surface 7 in contact with the middle ply. The middle ply 3 has an outer surface 8 in contact with the surface 5 and an inner surface 9 in contact with the surface 7.

The invention contemplates that the outer and inner plys be physically and frictionally engaged respectively with the sling and the load so that they are immovable with respect to the same. Ordinarily, the material of the sling and the geometry and/or the material of the load will insure this condition.

Ply 1 is constructed of conventional flexible nylon webbing. The outer surface has a coating of DuPont Merlon. The plys 2 and 3 are similarly constructed. The DuPont Merlon provides a coating which is hard and abrasive resistant.

The inner ply and the respective coatings which are in contact will accomodate and permit the relative sliding motion of the inner and outer plys. Thus, with the ply 1 gripped by the sling and the ply 2 gripped by the load and with the lifting conditions requiring relative sliding motion between sling and load, the outer and inner plys along with the sling and load can slide relative to the inner ply.

In FIG. 1 I have illustrated the structure of the pad of FIG. 4 in folded out condition.

Across the ends 10, 11 and 12 or the ply is a strap 13 also constructed of nylon webbing which is secured to the respective plys as by the stitching 14. A flexible strap 15 is similarly secured to the opposite ends of the plys.

The extension 20, 21, 22 and 23 of the respective straps provide means for tying the pad to the left as will be explained below.

To put the pad of FIG. 1 in condition for use with a sling the plys are flipped over so that they are stacked or in sandwich like form. For example, the plys of FIG. 1 have been turned or flipped over to produce the configuration as shown in FIG. 2 as by flipping over ply 3 on top of 1 and then flipping ply 2 over on the top of ply 3.

It will be apparent that several ways are available for making the stacked or sandwich type construction, for example, the ply 2 can be turned over on ply 1 and then the ply 3 folded back on ply 2. In any event, regardless of the manner in which the plys are folded the flexible straps and the spacing S-1 and S-2 between the plys provide that the three plys have a rather sloppy or movable relationship when folded over one another. The relationship permits the relative motion of plys.

Also, it will be apparent from an inspection of the figures that the ends, 20, 21, 22 and 23 of the strap can be conveniently manipulated to attach the folded-over plys directly to the sling. For example, with reference to FIG. 2 the end 23 can be tucked behind the spacer section 27 and the end 22 tucked behind the spacer 26 and then the two ends 22 and 23 brought out and tied to the sling. The opposite end of the pad can be similarly arranged.

In instances where the load has a sharp corner, the invention contemplates the use of a soft material such as a section of synthetic rubber or plastic urethane to be inserted between the sharp corner of the load and the inner ply. The effect of introducing the soft material is to assist in distributing the stress concentrations over and into the pad rather than concentrating the stress distribution in the area encompassed by the corner of the load which engages the inner ply. This is desirable from the standpoint of prolonging the life of the sling.

While I have shown and described the pad of the invention as being interposed between the sling and the bottom of the load it will be understood that certain type loads have vertical height such that the introduction of a pad on the top corner of the load is desirable.

I have shown and described the pad as being demountable, that is to say, in normal operations to be attached and be detached from the sling. However, the invention contemplates a combination of a sling with one or more pads permanently attached. For this purpose the ends of the plys are joined by strap-like webbing set up to provide the necessary sloppy or movable relationship between plys. Also, the outer ply is provided with a flexible sleeve or socket preferably made of nylon webbing and stitched on the surface ply and dimensional to accept the sling. The sleeve not only holds the pad on the sling, but provides for the pad to be adjustable along the sling to any desired position in accordance with the load.

The pad has been described in connection with the overhead slings. It will be understood, of course, that the pad has use in other areas. For example, in analogous areas where heavy, shifting loads must be confined by a sling or a tie-down. A typical example is the chains or cables used to tie down heavy steel loads on flat bed trailers. In such instances the pad is used between the load and the tie-down for exactly the same purpose as it is used in the overhead sling, i.e., to avoid cutting and damage.

Figure 5:
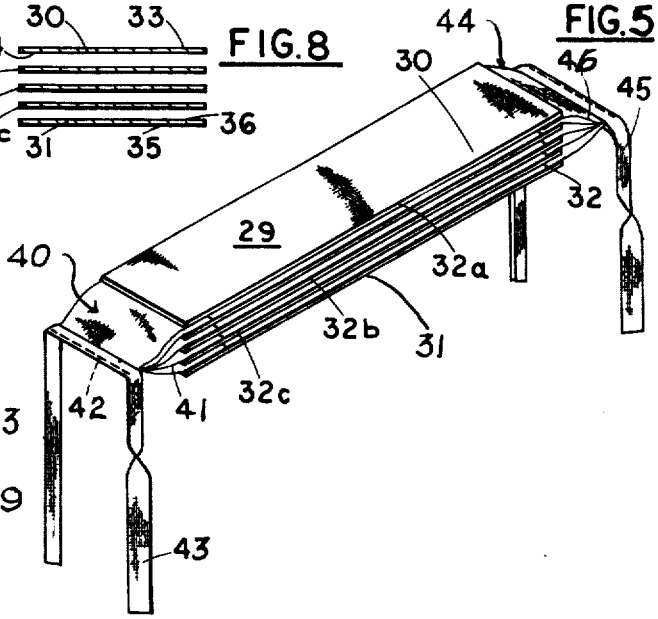
FIG. 5 is a perspective view of another embodiment of a sling pad the construction in accordance with the invention.
Figure 6:
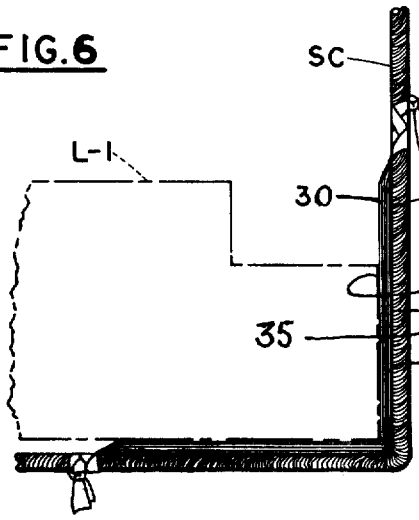
FIG. 6 is a fragmentary view illustrating the pad of FIG. 5 interposed between a sling and a load.

In FIG. 5 a modified pad 29 of the invention includes the inner ply 30 and the outer ply 31 and a plurality of intermediate plys 32. As indicated there are three intermediate plys **32*a*, 32*b* and 32*c*. In FIG. 6 the pad 29 is shown disposed between the load L-1** and the sling SC.

The inner ply 30 has an outer surface 33 for direct contact with a load and also has an inner surface 34 which is in direct contact with the intermediate ply **32*a*. The outer ply 31 has an outer surface 35 for direct contact with the sling and an inner surface 35 for direct contact with the sling and an inner surface 36 in contact with the intermediate ply 32*c*.**

The plys 30, 31, and **32*a*, 32*b* and 32*c* are constructed of conventional flexible nylon webbing. The outer surfaces of the intermediate plys have a coating of DuPont Merlon. The inner ply 30 does not have this coating. Also the coating may be eliminated on the outer ply 31.** The effect of the foregoing is to make the inner and outer plys softer than the intermediate plys.

The differential softness feature is important and highly advantageous particularly for lifting loads with sharp corners. The softer material of the inner ply has the effect of distributing or spreading out the compressive forces due to the sharp corner on the adjacent intermediate plys. The other intermediate plys further distribute, or spread out these compressive forces. Moreover, the softer material particularly of the inner ply enhances the gripping engagement between the inner ply and the load and thereby improves the ability of the inner ply to move when the load moves.

The multiple intermediate ply arrangement is especially advantageous in that it improves the condition for relative sliding motion as between the inner and outer plys.

Preferably in the construction of FIG. 5 the ends of the various pads are joined by flexible connectors which permit the sliding motion as previously described. Thus the left hand end of the plys in FIG. 5 has connector 40 comprised of flexible nylon webs 41. Each web extends across and is stitched to the end of its ply. The outer ends of the webs are commonly joined as by stitching indicated at 42. A tie strap 43 made of flexible, nylon webbing is also stitched along the joint area. The right hand end of the pad has a similar construction, the flexible connector being indicated at 44 and the tie strap at 45, the strap and connector being joined by the stitches indicated at 46.

Figure 7:
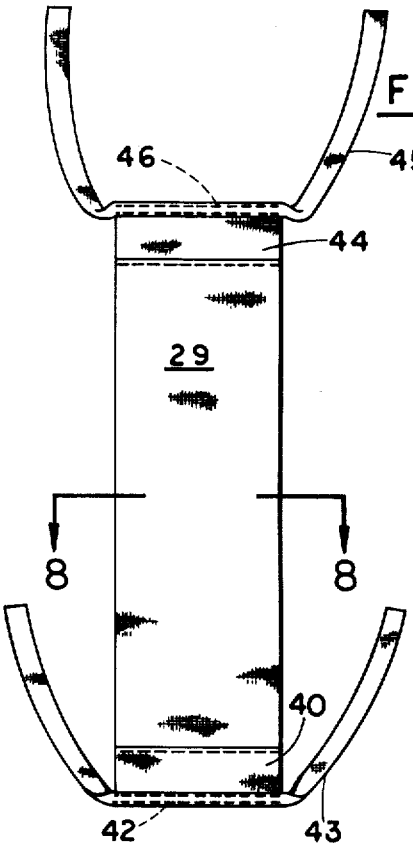
FIG. 7 is a plan view of the pad of FIG. 5 illustrating one method for arranging the tie straps.
Figure 8:
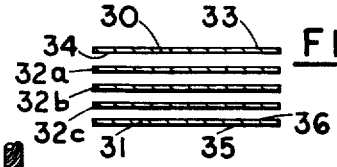
FIG. 8 is a view taken along the lines 8-8 in FIG. 7.

As noted in FIGS. 5 and 7 the flexible tie straps 43 and 45 extend fully across the width of the pad. In lieu of this construction the invention contemplates arranging the tie straps so that the free ends are close together, preferably being separated by a distance somewhat greater than the width of a cable-type sling. This construction is shown in FIG. 9 wherein the tie straps 47 and 48 are stitched to the connectors so as to extend inwardly from the edges of the pad 29' and terminate closely adjacent the cable sling SC'. With this construction it is preferred to use a pair of intermediate tie straps such as the tie straps indicated at 49.

With the foregoing arrangement the pad can be tightly secured to the sling. This is very useful where the sling is to make repeated lifts on articles of the same configuration and it is desired to maintain the pads in a fixed position on the sling for this repetitive work.

Figure 10:
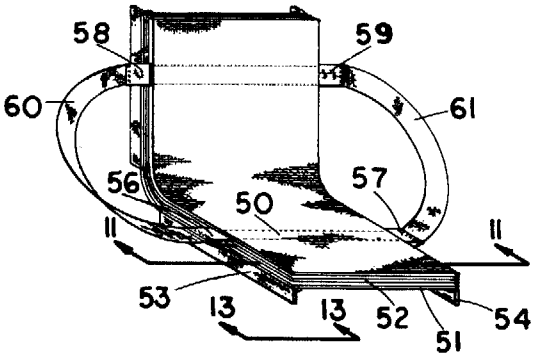
FIG. 10 is a perspective view of a sling pad especially adapted for use at corner of load.
Figure 11:
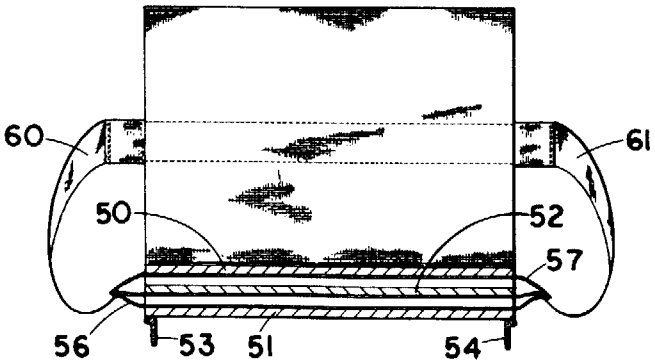
FIG. 11 is a front view (enlarged) of the pad of FIG. 10.

In FIGS. 10 and 11 I have shown an L-shaped clutch pad which is especially constructed for use on the corner of a load. In addition to the advantages heretofore mentioned, the corner clutch pad is especially useful in that it is maintained in an L-shaped condition and this enables the sling to be quickly set up or adjusted with respect to the corner of the load.

Figure 13:
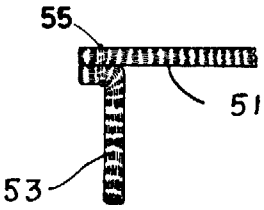
FIG. 13 is an end view taken along lines 13-13 in FIG. 10.

In FIG. 10 the pad includes an inner ply 50, an outer ply 51 and intermediate ply 52. These plys are made from nylon webbing as the plys heretofore described. The inner ply 50 is for placing in direct contact with the load and the outer ply is for direct contact with the sling which preferably is the wide band type. For maintaining the L-shaped condition, the outer ply 51 may be coated with polyurethane which makes the ply sufficiently stiff. Legs 53 and 54 extend outwardly from the outer ply and are also coated with polyurethane. The legs serve as guards for maintaining the sling in position especially just prior to a lift. The legs 53 and 54 are stitched to the outer ply by stitches 55 as indicated in FIG. 13.

The plys are fastened together by the flexible connector means 56, 57, 58 and 59 in the form of thin flexible nylon webs which are stitched across the respective plys. The flexible straps 60 and 61 are stitched to the retainer means.

Figure 14:
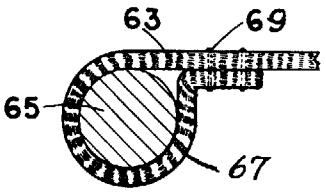
FIG. 14 is an end view taken along lines 14-14 of FIG. 12.
Figure 12:
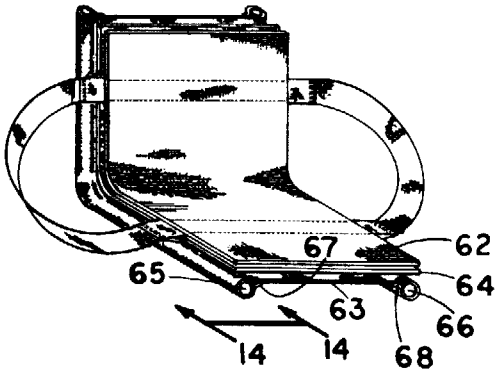
FIG. 12 is a perspective view of another embodiment of a corner pad.

In FIG. 12 I have shown another arrangement for maintaining a pad in an L-shape. The pad includes the inner ply 62 for contacting the load, the outer ply 63 for contacting the sling and the intermediate ply 64. For maintaining the L-shaped condition I have provided a pair of bent steel rods 65 and 66 which are nested within bent over portions 67 and 68 of the outer ply 63. The bent over portions of the outer ply are stitched back on the ply as indicated by the stitches 69 in FIG. 14. The bent over portions of the outer ply serve as guards similarly as the legs 53 and 54.

I claim:

1. A sling clutch pad for use between a load and a sling for lifting the load, the pad permitting relative sliding motion between the load and the sling, the clutch pad comprising:

outer ply means having an outer surface for engaging the sling and the outer ply means also having an inner surface;

inner ply means having an outer surface for engaging the load, the outer surface providing for an engagement which, when the load moves, renders the inner ply capable of moving with it and the inner ply also having an inner surface, said two inner surfaces facing one another when the outer ply engages the sling and the inner ply engages the load for the lifting operation and the plys maintaining the load and the sling spaced from and out of direct contact with one another; and slide permitting means on said inner surfaces and operative when the sling and pad are in lifting condition to permit relative sliding motion between the inner and outer plys and thereby provide for relative sliding motion between the load and the sling without the load and sling being in direct contact.

2. A construction in accordance with claim 1 wherein said slide permitting means comprises a plurality of ply means.

3. A construction in accordance with claim 1 wherein the inner and outer plys and said slide permitting means are formed so that the pad is L-shaped and further including means to maintain the L-shaped condition.

4. In combination, a sling to be disposed around the underside of a load and at least one clutch pad interposed between the load and the sling and maintaining the load and the sling spaced from and out of direct contact with one another and the pad having a plurality of members capable of sliding motion relative to each other and thereby providing for relative sliding motion between the load and the sling while spaced from one another and one of said members being in contact with the load and constructed to be capable of moving with the load when the load moves, said relative sliding motion between the sling and the load while spaced from one another providing that the movement of the load does not cut or abraid at least the sling material.

5. A construction in accordance with claim 4 wherein each said member is constructed of substantially flat, elongated, flexible webbing.

6. A sling clutch pad for use between a load and an overhead sling for lifting the load, the pad permitting relative sliding motion between the load and the sling without the load and the sling being in direct engagement, the pad comprising:

a first ply comprising a generally flat, elongated piece of webbing having a coating of abrasive resistant material;

a second ply comprising a generally flat, elongted piece of webbing having a coating of abrasive resistant material;

a third ply comprising a generally flat, elongated piece of webbing having a coating of abrasive resistant material;

a second flexible tie strap connected to the opposite corresponding ends of said plys, and having an extension for use in securing the pad in position, the straps providing for the plys to be folded one over the other whereby one ply is between the other two.

7. A sling clutch pad for use between a load and a sling, the pad permitting relative motion between the load and the sling, the pad comprising:

an outer ply, the outer ply being for use in engaging the sling;

an inner ply, the inner ply being for use in engaging the load and constructed for the engagement to provide that when the load moves the inner ply is capable of moving with it;

a plurality of intermediate plys respectively disposed between the inner and outer plys, the outer, inner and intermediate plys maintaining the load and the sling spaced from and out of direct contact with one another and the intermediate plys being constructed so as to be capable of sliding motion relative to one another and with the inner ply when the sling and pad are in lifting condition to thereby provide for relative sliding motion between the load and the sling without the load and the sling being in direct contact; and flexible connector means connecting the outer, inner and intermediate plys together while permitting said sliding motion.

8. A construction in accordance with claim 9 wherein at least the inner ply is constructed to be softer than the intermediate plys.

9. A construction in accordance with claim 8 wherein the outer, inner and intermediate plys are each comprised of a generally flat, elongated piece of webbing.

10. A construction in accordance with claim 9 further including two pairs of flexible tie straps respectively secured to the connector by extending from the end of the connector inwardly toward the center and terminating in a free end for use in tying the pad in position for lifting.

11. A sling clutch pad for use between a load and an overhead sling for lifting the load, the pad permitting relative sliding motion between the load and the sling, the pad comprising:

L-shaped outer ply means having an outer surface for engaging the sling and the ply also having an inner surface;

L-shaped inner ply means having an outer surface for engaging the load, the outer surface engagement holding the inner ply against the load so that when the load moves the inner ply moves with it and the ply also having an inner surface, said two inner surfaces facing one another when the outer ply engages the sling and the inner ply engages the load for lifting operation and the plys maintaining the load and the sling spaced from and out of direct contact with one another;

L-shaped, slide permitting means disposed between said inner surfaces and operative when the sling and pad are in lifting condition to permit relative sliding motion between the inner and outer ply menas and thereby provide for relative sliding motion between the load and the sling without the load and sling being in direct contact; and retainer means connected with one of said ply means and operative to maintain said L-shaped condition.

12. A construction in accordance with claim 11 wherein said retainer means is rigid coating of polyurethane on one of said ply means.

13. A construction in accordance with claim 11 wherein said retainer means is a metal member.

14. A construction in accordance with claim 11 wherein said slide permitting means comprises at least one intermediate ply means.

15. A construction in accordance with claim 14 further including flexible connector means connecting the inner, outer and intermediate plys together while permitting said sliding motion.

16. A sling clutch pad for use between a load and a sling for lifting the load, the pad permitting relative sliding motion between the load and the sling, the clutch pad comprising;

outer ply means having an outer surface for engaging the sling and the outer ply means also having an inner surface:

inner ply means having an outer surface for engaging the load, the outer surface providing for an engagement which, when the load moves, renders the inner ply capable of moving with it and the inner ply also having an inner surface, said two inner surfaces being disposed to face one another when the outer ply engages the sling and the inner ply engages the load for the lifting operation and the plys maintaining the load and the sling spaced from and out of direct contact with one another; and slide permitting intermediate ply means disposed between said inner surfaces and operative when the sling and pad are in lifting condition to permit relative sliding motion between the inner and outer plys and thereby provide for relative sliding motion between the load and the sling without the load and sling being in direct contact.

17. A construction in accordance with claim 16 wherein said slide permitting intermediate ply means comprises at least one ply means and wherein the outer and inner ply means are constructed to be softer than said intermediate ply means.

18. A sling clutch pad for use between a load and a sling for lifting the load, the pad permitting relative sliding motion between the load and the sling, the clutch pad comprising:

outer ply means constructed of nylon webbing and having an outer surface for engaging the sling and the outer ply means also having an inner surface, the inner surface having an abrasive resistant coating:

inner ply means constructed of nylon webbing and having an outer surface for engaging the load the outer surface providing for an engagement which, when the load moves, renders the inner ply capable of moving with it and the inner ply also having an inner surface having an abrasive resistant coating, said two inner surfaces being disposed to face one another when the outer ply engages the sling and the inner ply engages the load for the lifting operation and the plys maintaining the load and the sling spaced from and out of direct contact with one another; and intermediate ply means constructed of nylon webbing and being disposed between said inner surfaces and operative when the sling and pad are in lifting condition to permit relative sliding motion between the inner and outer plys and thereby provide for relative sliding motion between the load and the sling without the load and sling being in direct contact.

19. A sling clutch pad for use between a load and a sling for lifting the load, the pad permitting relative sliding motion between the load and the sling, the clutch pad comprising:

outer ply means constructed of substantially flat, elongated, flexible webbing and having an outer surface for engaging the sling and the outer ply means also having an inner surface;

inner ply means constructed of substantially flat, elongated, flexible webbing and having an outer surface for engaging the load, the outer surface providing for an engagement which, when the load moves, renders the inner ply capable of moving with it and the inner ply also having an inner surface, said two inner surfaces being disposed to face one another when the outer ply engages the sling and the inner ply engages the load for the lifting operation and the plys maintaining the load and the sling spaced from and out of direct contact with one another; and slide permitting intermediate ply means constructed of substantially flat, elongated, flexible webbing and disposed between said inner surfaces and operative when the sling and pad are in lifting condition to permit relative sliding motion between the inner and outer plys and thereby provide for relative sliding motion between the load and the sling without the load and sling being in direct contact.

* * * * *